United States Patent [19]

DeCesaris

[11] 4,057,980

[45] Nov. 15, 1977

[54] EARRING WITH ORNAMENT OF NON-RIGID PLASTIC HAVING RESILIENT FILLER

[76] Inventor: Adolph DeCesaris, 39 N. Olney St., Johnston, R.I. 02919

[21] Appl. No.: 465,139

[22] Filed: Apr. 29, 1974

[51] Int. Cl.[2] ..... A44C 7/00

[52] U.S. Cl. ..... 63/13

[58] Field of Search ..... 46/156; 63/2, 13, 12; 5/338

[56] References Cited

U.S. PATENT DOCUMENTS

| | | | |
|---|---|---|---|
| 2,797,561 | 7/1957 | Vaughn | 63/13 |
| 3,040,353 | 6/1962 | Gray | 161/190 X |
| 3,141,261 | 7/1964 | Mirando | 46/156 X |
| 3,323,151 | 6/1967 | Lerman | 161/190 UX |
| 3,345,830 | 10/1967 | Fontaine | 63/13 |
| 3,443,398 | 5/1969 | King | 63/13 |
| 3,699,714 | 10/1972 | Rosen | 46/156 X |

*Primary Examiner*—F. Barry Shay

*Attorney, Agent, or Firm*—Salter & Michaelson

[57] ABSTRACT

An earring construction having a body portion formed of a non-rigid plastic material in which a resilient filler material is located, the plastic body portion being formed of opposed sections that are die cut and heat sealed in a predetermined configuration, and an opening being formed in the body portion adjacent to a peripheral edge thereof for receiving a mounting member that suspends the earring from the ear lobe of a wearer.

5 Claims, 6 Drawing Figures

EARRING WITH ORNAMENT OF NON-RIGID PLASTIC HAVING RESILIENT FILLER

BACKGROUND OF THE INVENTION

The present invention relates to earrings and particularly pierced earrings that are attached to the ear lobe of a wearer by a mounting member.

Various kinds of designs and configurations are utilized in earring constructions, the only criteria being that the earring design by ornamentally attractive when worn on the ear of the wearer. Prior to the instant invention, various kinds of materials have also been utilized with pierced earrings; although, in a general sense, the findings or base portions of pierced earrings known heretofore have generally been constructed of a metallic material. Gems and other ornamental stones are usually fixed to the metal finding, and in general this has defined the conventional earring construction in use heretofore.

Some earring constructions have deviated from the usual form and have been constructed of nonmetallic materials, such as wood, rigid plastic, ceramic or the like; and such prior known earrings have found some favor in the trade. Because all of the prior known earring constructions were formed of rigid materials, it was difficult to incorporate designs therein for simulating fabric designs or for artificially reproducing other design effects, and usually the earring construction selected by the user was of a coloration or design that merely complimented the wearer's clothing.

SUMMARY OF THE INVENTION

The present invention relates to an earring construction that comprises a body portion formed of a nonrigid plastic material defined by corresponding opposed sections, the sections preferably being formed of a sheet-like plastic material having an exterior design of any suitable configuration or design imprinted thereon. The opposed sections are simultaneously die cut in the required configuration and heat sealed along the peripheral edges thereof. Captured within the interior of the body portion is a filler portion formed of a resilient material that provides some body to the sheet-like sections so that the body portion can be formed in a specific configuration. In order to mount the earring construction on the ear lobe of the wearer, an opening is formed in the body portion adjacent a peripheral edge thereof, a mounting member such as a post, ear clip or earwire being received in the opening.

Accordingly, it is an object of the present invention to provide an earring construction having a body portion formed of a nonrigid plastic material.

Another object of the invention is to provide an earring construction that includes opposed sections that are formed in a desired configuration, the peripheral edges of the sections being joined together by heat sealing.

Still another object is to provide an earring construction formed of a nonrigid plastic material in which a semirigid filler portion is located.

Still another object is to provide a plastic earring, that includes a body portion formed of a nonrigid plastic material and a filler portion formed of a resilient material located within the body portion, an opening being formed in the body portion adjacent to a peripheral edge thereof for receiving an earwire that mounts the earring construction on the ear lobe of a wearer.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
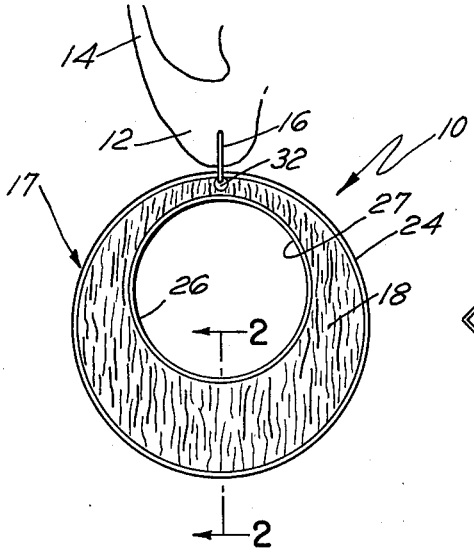
FIG. 1 is a front elevational view of one form of the earring construction embodied in the present invention as mounted on an ear of a wearer.
Figure 2:
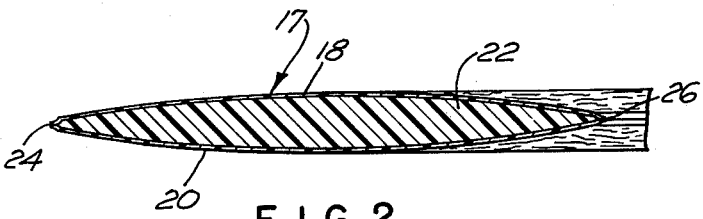
FIG. 2 is a sectional view of a portion of the earring shown in FIG. 1 taken along line 2—2.
Figure 4:
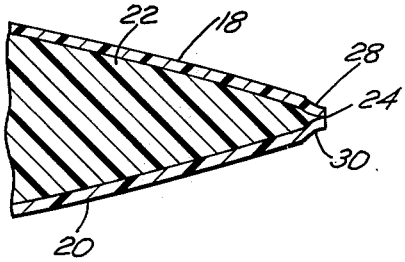
FIG. 4 is a fragmentary enlarged sectional view showing the mating peripheral edges of the opposed sections that define the earring construction shown in FIG. 1.
Figure 3:
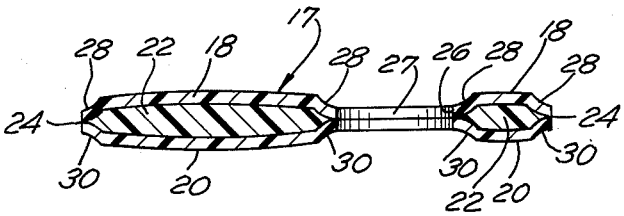
FIG. 3 is a vertical sectional view of the earring construction illustrated in FIG. 1.

Referring now to the drawings and particularly to FIGS. 1–3, one form of the present invention is illustrated and includes an earring construction generally indicated at 10. As shown in FIG. 1, the earring construction 10 is mounted on an ear lobe 12 of a wearer's ear 14 by an earwire 16, the attachment of the earwire 16 to the earring construction 10 being described hereinafter.

The earring construction 10 may be formed in various shapes and configurations, the crescent configuration illustrated in FIG. 1 being only one of many designs that is contemplated by the present invention. The earring construction 10 includes a body portion generally indicated at 17 that is defined by opposed sections 18 and 20. Each of the sections 18 and 20 is formed of a nonrigid vinyl plastic material in sheet form, which may be suitably decorated on the surface thereof with a design that simulates a fabric, wood or that is formed in any arbitrary artistic or ornamental design. Located between the opposed sheet-like sections 18 and 20 and defining the interior of the earring construction 10 is a filler portion 22 that is somewhat resilient in construction and preferably is formed of a semirigid foamed plastic such as polyurethane or polyvinyl chloride or the like.

As shown in FIG. 1, the body portion 17, which includes the opposed sheet-like sections 18 and 20, has an outer peripheral edge 24 and an interior peripheral edge 27 defined by an opening 27, the peripheral edges 24 and 26 being defined by mating edges 28 and 30 of the plastic sheet sections 18 and 20, respectively. The mating edges 28 and 30 of the sections 18 and 20 are joined together by heat sealing in a well known manner, the sealed peripheral edges 24 and 26 of the sections 18 and 20 capturing the foamed filler portion 22 between the sections as illustrated in FIGS. 2 and 3. It is also understood that the peripheral edges of the flexible and foamable filler material may be heat sealed between the edges of the vinyl sections.

The sections 18 and 20 are formed by die cutting opposed sheets of vinyl material that have been preformed with a required design imprinted thereon. A sheet of the filler material 22 is placed between the opposed vinyl sheets from which the sections 18 and 20 are cut and simultaneously with the die cutting of the sections 18 and 20 into the selected design, the edges 28 and 30 are heat sealed in the well known manner to capture the filler portion 22 between the sections 18 and 20.

At the time that the earring construction 10 is formed by die cutting the vinyl sheets and by heat sealing the mating edges 28 and 30 of the sections 18 and 20, respectively, to form the peripheral edges 24 and 26, an opening 32 is also punched through the body portion 17 adjacent to an edge thereof, the opening 32 being utilized to receive the earwire 16 therethrough. Thus, when the peripheral edges 24 and 26 are sealed as shown, and the opening 32 is formed in the body portion 17 of the earring construction, the earwire 16 is inserted through the opening 32, and the earring is then ready for mounting on the earlobe 12 of the wearer's ear 14. It is understood that an ear clip or post may also be received in the opening 32 for mounting the earring on the wearer's ear.

Figure 5:
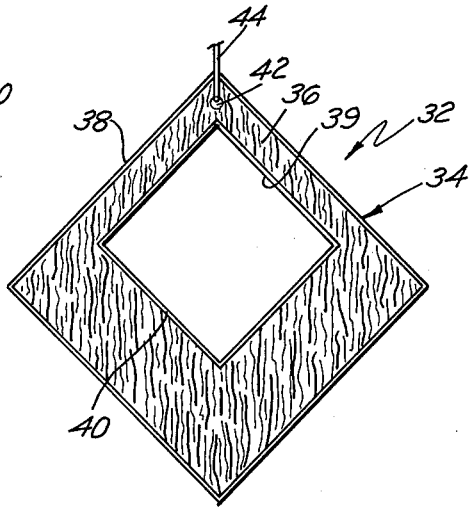
FIG. 5 is a front elevational view of a modified form of the present invention.

Referring now to FIG. 5, a modified form of the invention is illustrated, which as shown is directed principally to the external configuration of the earring construction and not to the constructional features thereof. As shown in FIG. 5, an earring construction generally indicated at 32 is illustrated and includes a body portion generally indicated at 34 that includes sections of vinyl plastic material, one of which is indicated at 36. The plastic sections 36 which are die cut from vinyl sheets have a suitable surface design formed thereon and are joined along mating edges that define an outer peripheral edge 38. The external shape and configuration of the body portion 34 generally forms a square, a square interior opening 39 being cut out within the body portion 34 to define an inner peripheral edge 40. The sections 36 are die cut and simultaneously heat sealed to seal the mating edges thereof to define the outer and inner peripheral edges 38 and 40 and to seal a foamed filler material between the sections. An opening 42 is also punched into the body portion 34 adjacent a corner when the sections are die cut and heat sealed, the opening 42 receiving an earwire 44 therein. The earwire 44 is formed in the usual manner and is receivable in the ear lobe 12 of a wearer; although a post or ear clip may also be used to mount the earring 32 on the wearer's ear.

Figure 6:
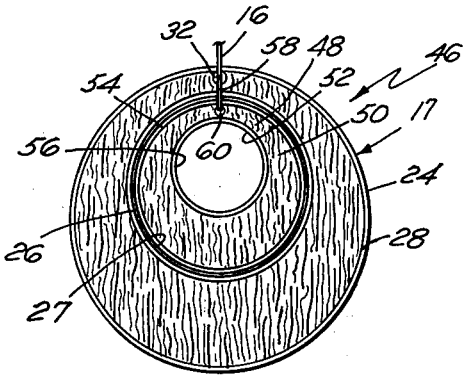
FIG. 6 is a front elevational view of a still further modified form of the present invention.

Referring now to FIG. 6, a still further modified form of the invention is illustrated and includes an earring construction generally indicated at 46 that includes the body portion 17, illustrated in FIG. 1; and a smaller body portion generally indicated at 48 that is formed of the same materials as that of body portion 17 and is cut out from the sheet vinyl material simultaneously therewith. The body portion 17 includes the sections 18 and 20 as previously described, and the edges thereof are heat sealed to capture the filler portion 22 therebetween. The body portion 48 is formed simultaneously with the body portion 17 and includes opposed sections, one of which is indicated at 50. The opposed sections 50 which are formed from the vinyl sheet material are heat sealed along the mating edges thereof to define outer and inner sealed peripheral edges 52 and 54 that seal a filler material between the sections 50, the inner peripheral edge defining an interior opening 56. The body portion 48 is positioned within the opening 27 and is joined to the body portion 17 by an earwire 58 that extends through the opening 32 and through an opening 60 as formed in the body portion 48. The earwire 58 is suitably attached or connected to the ear lobe 12 of the wearer in the usual manner. It is understood that a post or ear clip can also be used to mount the earring construction 46 on the wearer's ear.

In all forms of the invention as illustrated and described herein, the opposed sections are preferably formed of a vinyl material that is capable of being formed with any suitable design on the exterior surface thereof. Thus, the vinyl sheet can have a fabric simulated thereon or even a simulated wood grain may be formed thereon, or any other desired design may be incorporated therein in accordance with the requirements for use.

It is also understood that when the sections of the body portion of the earring construction are die cut to the configuration required, the peripheral edges thereof are simultaneously heat sealed to capture the filler portion therebetween. The filler portion which is formed of a foamable plastic material adds body to the earring and provides sufficient rigidity to the sheet-like opposed sections to enable the exterior configuration of the earring construction to be formed as illustrated.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An earring construction of the piercing type, comprising a body portion formed of a nonrigid plastic material, a filler portion formed of a resilient material located within said body portion, an opening formed in said body portion adjacent to a peripheral edge thereof and an earwire extending through said opening and being attachable to the ear lobe of a wearer for mounting the earring construction on the wearer's ear.

2. An earring construction as claimed in claim 1, said body portion including corresponding opposed sections, each of which has peripheral edges that correspond in configuration to the other section, the peripheral edges of said sections being located in sealing and mating relation.

3. An earring construction as claimed in claim 2, the mating peripheral edges of said opposed sections being heat sealed together.

4. An earring construction as claimed in claim 2, said filler material being a foamed plastic material.

5. An earring construction as claimed in claim 4, said sections being formed of a sheet-like plastic material.

* * * * *